United States Patent [19]

Nelson et al.

[11] 4,373,719

[45] Feb. 15, 1983

[54] ELECTRONIC BRIDGE GAME SYSTEM

[75] Inventors: Ronald C. Nelson; Richard L. Merrick, Jr., both of Miami, Fla.

[73] Assignee: Fidelity Electronics, Ltd., Miami, Fla.

[21] Appl. No.: 109,495

[22] Filed: Jan. 4, 1980

[51] Int. Cl.[3] ..... A63F 1/00

[52] U.S. Cl. ..... 273/1 E

[58] Field of Search ..... 273/1 E, 1 G, 1 C, 138 A, 273/148 R, 149 P, 237, 292; 235/92 GA, 462; 340/323 R; 364/410; 434/129, 355-360

[56] References Cited

U.S. PATENT DOCUMENTS

| | | | |
|---|---|---|---|
| 2,023,210 | 12/1935 | Potter | 273/149 P |
| 4,030,764 | 6/1977 | Mattos | 273/148 A |
| 4,072,310 | 2/1978 | Beam | 273/1 E |
| 4,093,215 | 6/1978 | Ballard | 273/138 A |
| 4,130,871 | 12/1978 | Olsen et al. | 340/323 R X |
| 4,173,342 | 11/1979 | Corrlieu-Ferran | 340/323 R X |
| 4,240,064 | 12/1980 | DevChoudhury | 235/462 |
| 4,259,667 | 3/1981 | Weber | 434/358 |
| 4,314,336 | 2/1982 | Bernstein et al. | 364/411 |
| 4,339,134 | 7/1982 | Macheel | 273/138 A |

OTHER PUBLICATIONS

*Washington Star*; Nov. 1979; p. 37.

*Primary Examiner*—Vance Y. Hum

*Attorney, Agent, or Firm*—Henry S. Kaplan

[57] ABSTRACT

An electronic game is provided for replacing and substituting for from one to four human players in the car game of bridge. The game receives the value and suit of cards for each hand or position it plays for receives bids from human players and calculates and responds with a responding bid for each hand that it plays on behalf of. It also receives values and suits of cards played by other players in each trick and responds with a responding card value and suit for each hand it plays on behalf of.

13 Claims, 6 Drawing Figures

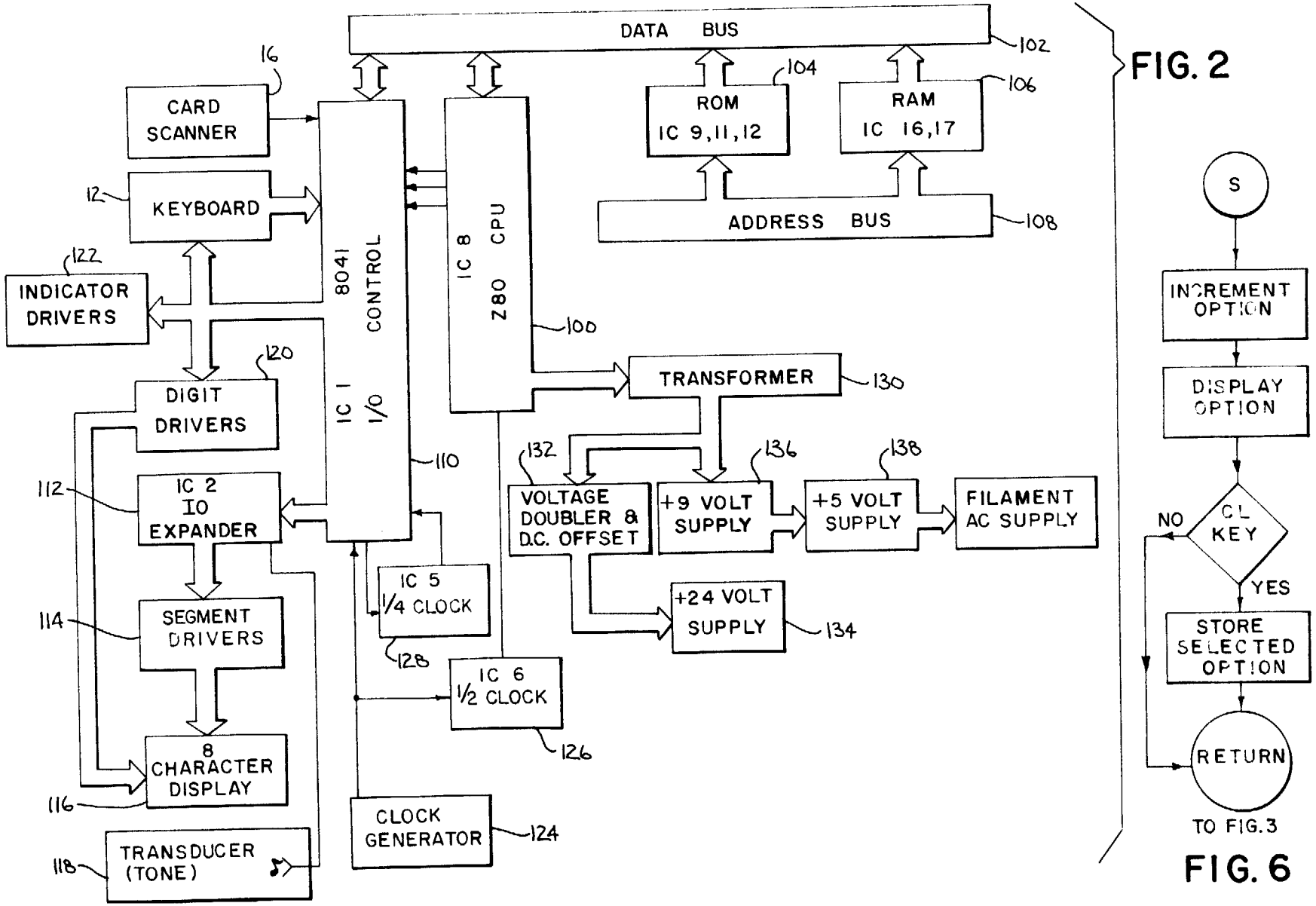
FIG. 2
S
INCREMENT OPTION
DISPLAY OPTION
CL KEY
YES
NO
STORE SELECTED OPTION
RETURN
TO FIG. 3
FIG. 6
DATA BUS
102
RAM IC 16,17
106
ROM IC 9,11,12
104
ADDRESS BUS
108
TRANSFORMER
130
FILAMENT AC SUPPLY
+5 VOLT SUPPLY
138
+9 VOLT SUPPLY
136
+24 VOLT SUPPLY
134
VOLTAGE DOUBLER & D.C. OFFSET
132
IC 8 Z80 CPU
100
IC 1 8041 I/O CONTROL
110
IC 5 1/4 CLOCK
128
IC 6 1/2 CLOCK
126
CLOCK GENERATOR
124
CARD SCANNER
16
KEYBOARD
12
INDICATOR DRIVERS
122
DIGIT DRIVERS
120
IC 2 IO EXPANDER
112
SEGMENT DRIVERS
114
8 CHARACTER DISPLAY
116
TRANSDUCER (TONE)
118

ELECTRONIC BRIDGE GAME SYSTEM

DESCRIPTION

TECHNICAL FIELD

This invention relates to a system and apparatus for substituting and replacing human players in a card bridge game.

BACKGROUND OF THE INVENTION

Numerous books and other articles have been written on systems to respond to certain deals of cards when playing bridge. Such material has dealt with not only instructions for bidding purposes but also instructions for playing the cards after the contract in a bridge game has been entered.

Also, programs have been written which have attempted to arrive at a responsive bid in response to a deal of cards and bids by other players in the game. These programs have often required large storage capacity of computers and have often required a knowledge of computer program language in order to use such a program. Further still, the hardware or other devices incorporating such a program have been cumbersome to move and operate.

The same disadvantages and drawbacks associated with devices for bidding in bridge, have also been inherent in devices and apparatus for instructing a player as to which card to play after the contract has been formed.

Thus, in order to implement a bridge game system having sufficient capability for bidding and playing, it is not just sufficient to have a technique for a computer to evaluate the possible bid responses and playing responses that it might make, it is also desirable to produce a device capable of being operated by a person who understands the game, but not necessarily having a thorough knowledge of computers or how to operate them. It would thus be useful to provide a device having necessary input and output features to permit the game to be played, as well as other features and capabilities to make the device attractive and practical, while retaining simplicity of operation and maintaining reasonable cost limitations.

SUMMARY OF THE INVENTION

In accordance with the present invention, there is provided a practical, computerized bridge game system in which the device can substitute for from one to four human players. The device has memory means for storing the identity of cards to be played by the device, a means to input the values of the identity of the cards and place them into the memory means, and input means for receiving bids from hands played by human players. A response evaluation program responds to bid inputs made by the human players in accordance with criteria stored in a first program memory, also using as a basis the identity of cards in a hand that the computer will play along with other criteria. When the computer program memory receives three consecutive pass bids, it stores the last hand bid made, along with position data, in the form of geographical position normally used in bridge, from which it was made, into a contract value memory means and stores it for later use.

After the bidding is complete by arriving at the contract value, the identity of cards in the dummy hand is inputted into the memory means if the dummy hand is a human hand. The play of the hands then commences, and the human players then feed into memory, via the card input means, the identity of the cards which they decide to play for that trick. When the system, or the computer, has its turn to play a card in a trick, it selects a responsive card identity from the cards in its hand based upon the identity of cards in that hand available to it in the memory means, the identity of the cards of the dummy hand, the value stored in the contract value memory means, the cards played in a trick, and in accordance with other preselected playing criteria stored in said memory means. It then displays to the human players, via a card display means, the identity of the selected responsive card.

Other features of the device include means to directly scan or interface the identity of a card into the input means so that it can be unexposed to human players, means to provide a selection of bid convention options to each partnership, scoring means for evaluating the trick results in light of the contract value stored in the contract value memory means, and other input means for replaying the tricks with the same card values originally dealt.

Thus, with the device and system of the present invention, the device can both bid and play cards with human players who do not need to understand computer language, and the device can be produced relatively inexpensively and be available to more members of the public.

Numerous other advantages and features of the present invention will become readily apparent from the following detailed description of the invention and one embodiment thereof, from the claims and from the accompanying drawing in which each and every detail shown is fully and completely disclosed as a part of this presentation.

BRIEF DESCRIPTION OF THE DRAWING

FIG. 2 is a block diagram of the major components utilized in the game of the present invention;

FIGS. 3, 4 and 6 are operational flow diagrams of part of the system incorporating the present invention.

DESCRIPTION OF THE PREFERRED EMBODIMENT

Figure 1:
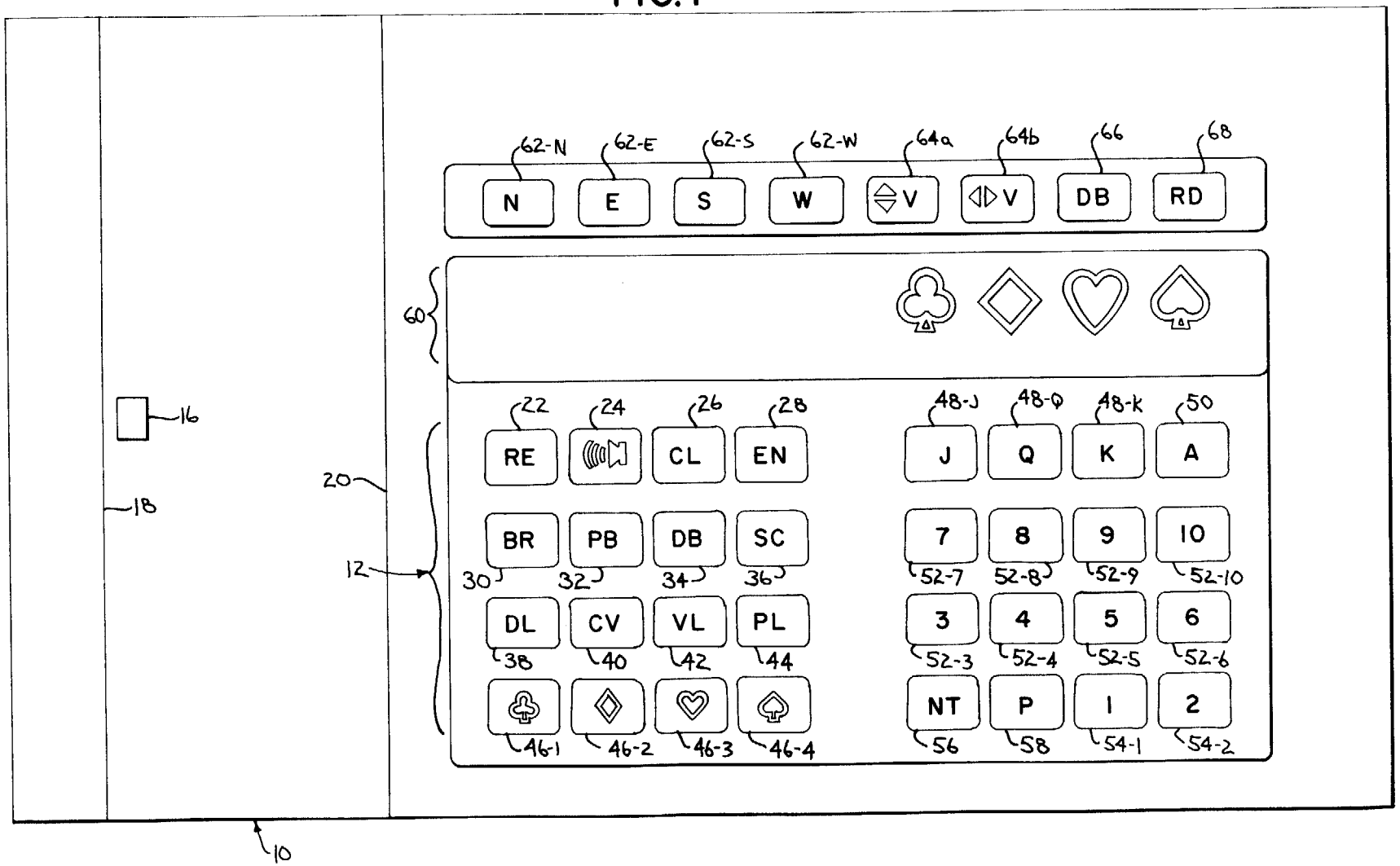
FIG. 1 is a plan view of the game for use in conjunction with the game playing system of the present invention.

While this invention is acceptable of embodiment in many different forms, there is shown in the drawing and will herein be described in detail one specific embodiment, with the understanding that the present disclosure is to be considered as an exemplification of the principles of the invention and is not intended to limit the invention to the embodiment illustrated.

A game system incorporating the present invention may be embodied in a compact unit 10 which includes keyboard input means 12 and output display means 14. Besides keyboard input means 12, an input scanning means 16 is provided at the left side of a channel formed by sides 18 and 20. Each card used with the game may be encoded with a bar code along its edge indicative of its identity, i.e., value and suit. This scanner 16 can thus read the bar code encoded on each card when the card is slid along the channel formed by edges 18 and 20. The input means thus comprises the input keyboard means 12 and the input scanning means 16.

The input keyboard means 12 comprises an array of manually actuable input keys. Starting with the upper row on the leftmost side, the key 22 functions to clear the memory of all previous game data and key 24 is an on-off switch which operates to turn on and off a tone generator, audible to the human players and responsive to actuation of any one of the input keys. Key 26 is a clear key which clears input data before it is entered into the computer memory. It also functions to allow a change in player status from human to computer and vice versa. Additionally, it functions to select one of various options and also changes the score as will later be described. Key 28 functions to finally enter input data into the computer memory after it is keyed in or scanned in through the other input means.

Starting with the second row, key 30 is a bridge review key which, when actuated during bidding, displays all bidding made to the present, and when actuated during playing the cards, displays all cards played in the present trick being played. Key 32 when actuated, permits changing the player status after bidding is completed and before playing of the cards has commenced. Key 34, a double key, functions to double or redouble a present bid. Key 36, when actuated, displays the present score status in the display.

The first key in the third row of keys, key 38, when actuated, allows one to select the player position that will be the dealer in the game. Key 40, when actuated, displays all convention options open to each of the partnerships before bidding commences. Key 42 functions to allow a change in vulnerability status of the partnerships while key 44 enables the computer to display the player status, e.g. human/computer, of each of the geographical positions.

The bottom row in the left-hand side of the input means 12 is a set of four keys 46 which are used to select the suit for a card entered or specifies which suit is being bid during the bidding sequence.

Keys 48 function to allow the player to input the value of a card entered into the computer game system, 48-J for a jack, 48-Q for queen and 48-K for a king. The A key 50 is used to indicate the ace value similar in function to keys 48, and also is used for a human player to acknowledge the computer's action or request for action on the part of a human. Keys 52, labeled 3 through 10, also function similarly to keys 48 in that they enable one to input the value of a card being entered. The same is true of keys 54, labeled 1 and 2; however both sets of keys 52 and 54 are also used in bidding to indicate the number value of a particular suit being bid. Key 56 is used during bidding and advises the computer of a no trump bid. Key 58, when actuated during the bidding sequence, advises the computer of a pass bid by a human, and when actuated during play of the cards is used for allowing the players to replay the hands after one or more tricks are made while using the same card values stored into the computer which were played in the previous deal.

Turning now to the display means 14, a display window 60 is an array of eight 14-segment alphanumeric, vacuum fluorescent display character indicators which can be visually lit by drivers in the computer and serve as a means to communicate the computer's moves and other information to the human players. Thus, during bidding, the display window will display the responsive bid value which the computer will make, and during playing of the cards, the display window will display the identity of the card which the computer decides to play. Display indicators 62 work in conjunction with display window 60 so that any time a particular piece of data or information visually displayed in display window 60 is associated with a particular geographical hand, that associated geographical position will be lit in the display row 62. When the display in window 60 relates to a partnership, one pair of displays in display row 62 will be lit, e.g. North-South or East-West pairs. Keys 64 indicate which partnership is vulnerable, **64*a* indicating that the North/South side is vulnerable, and 64*b* indicating that the East/West side is vulnerable. Indicator 66, when lit, indicates that a bid has been doubled by a human or computer and indicator 68** indicates that a bid has been redoubled.

Turning now to FIG. 2, a block diagram is shown illustrating the major components utilized in the game of the present invention. The basic circuitry of the computer involves eight major functions. A power supply provides the various operating voltages to the various components. A keyboard, including a card scanner, provides a means for the player to communicate with the unit and to input information into the unit. Display end indicators provide a means for the unit to communicate visually and audibly with human players. A central processor or CPU makes decisions and controls all system activity. An input/output interface is a second processor which acts as a slave to the first processor and effects all input and output activity. There are basically two memories, the first a ROM memory which contains bridge programs and criteria for responding to human bids and human plays of cards to give a computer played bid and computer played card identity in response thereto. The RAM memory temporarily stores information during play execution. Lastly, a timing generator provides precise timing trains for data movement, processing, and input/output functions.

The operation of the system can best be described in terms of two separate basic functions: (1) internal processing, and (2) input/output control. The internal processing is controlled by central processing unit CPU component 100, an integrated circuit which handles the execution of programmed instructions via data bus 102 from the read only memory 104 (ROM), and also stores temporary information, such as card input, card location, etc., in the random access memories 106 (RAMs). The read only memory (ROM) 104 contains a permanent playing program that cannot be altered by human players. The CPU 100 addresses the ROM 104 and RAM 106 components via address bus 108.

The input/output control components include a card scanner input 16, keyboard input means 12, character display and display windows 60, including LED illumination, and transducer sound control controlled by input key 24. Essentially, the input/output control unit 102 affects an interface between the human players and the CPU component 100.

An integral part of the output circuitry is the input/output expander 112. This expander serves to interpret encoded display information from the input/output control 110 and converts it to drive segment drivers 114 and eight character LED displays 116 in display window 60. Input/output expander 112 also drives the transducer 118. The character displays 116 can also be driven by digit drivers 120 which in turn are driven by the input/output control 110. Input/output control 110 also drives indicator drivers 122 which in turn drives indicators 62, 64, 66 and 68. The input/output control 110 is preferably a IC8041 and the CPU 100 is preferably a ICZ80.

A clock generator 124 establishes and controls system timing, using a five megahertz crystal oscillator network to maintain precise system operation at a constant speed. A one-half clock 126 receives signals from the clock generator and provides an input to the CPU 100. The CPU 100 operates at one-half of the basic clock speed. A one-quarter clock 128 is a divide-by-four device in the system timing circuit and works off a synchronized pulse train from the input/output control 110. The one-quarter clock 128 provides internal timing for slower speed operation such as card scanning, keyboard input, and display refresh pulses, and also provides the trigger for the AC type (pulsed DC) voltage for the display filament voltage.

The power supply circuit uses 10 volts of AC secondary power supplied by an external transformer 130. A voltage doubler 132 provides an unregulated 24 volts to 24 volt supply 134 for the segment and digit drivers 114 and 120. A bridge rectifier circuit provides unregulated 9 volts DC to the 9 volt supply 136 which is used to bias the filament drive transistor and to supply 9 volts to the 5 volt regulator. A 5 volt supply 138 receives 9 volts input from 9 volts supply 136 and, with regulation and filtering, provides straight line voltage to operate the integrated circuits (ICs) in the system. AC filament voltage for the vacuum fluorescent displays is provided by means of a transistor chopper. The transistor is driven by one-quarter clock 128, the divide-by-four generator, which sets of the DC pulse train to provide the AC type filament voltage.

Figure 3:
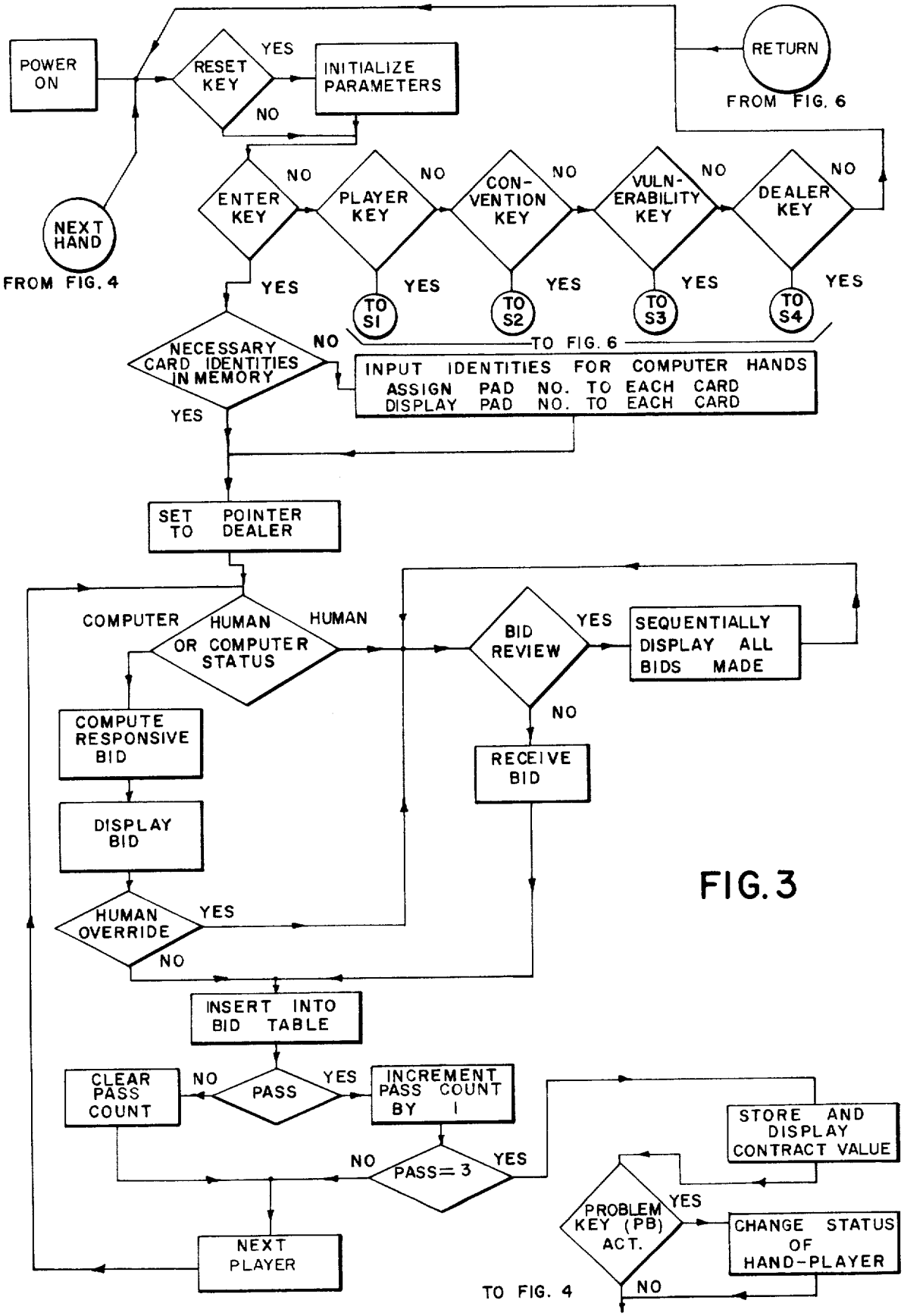
Figure 4:
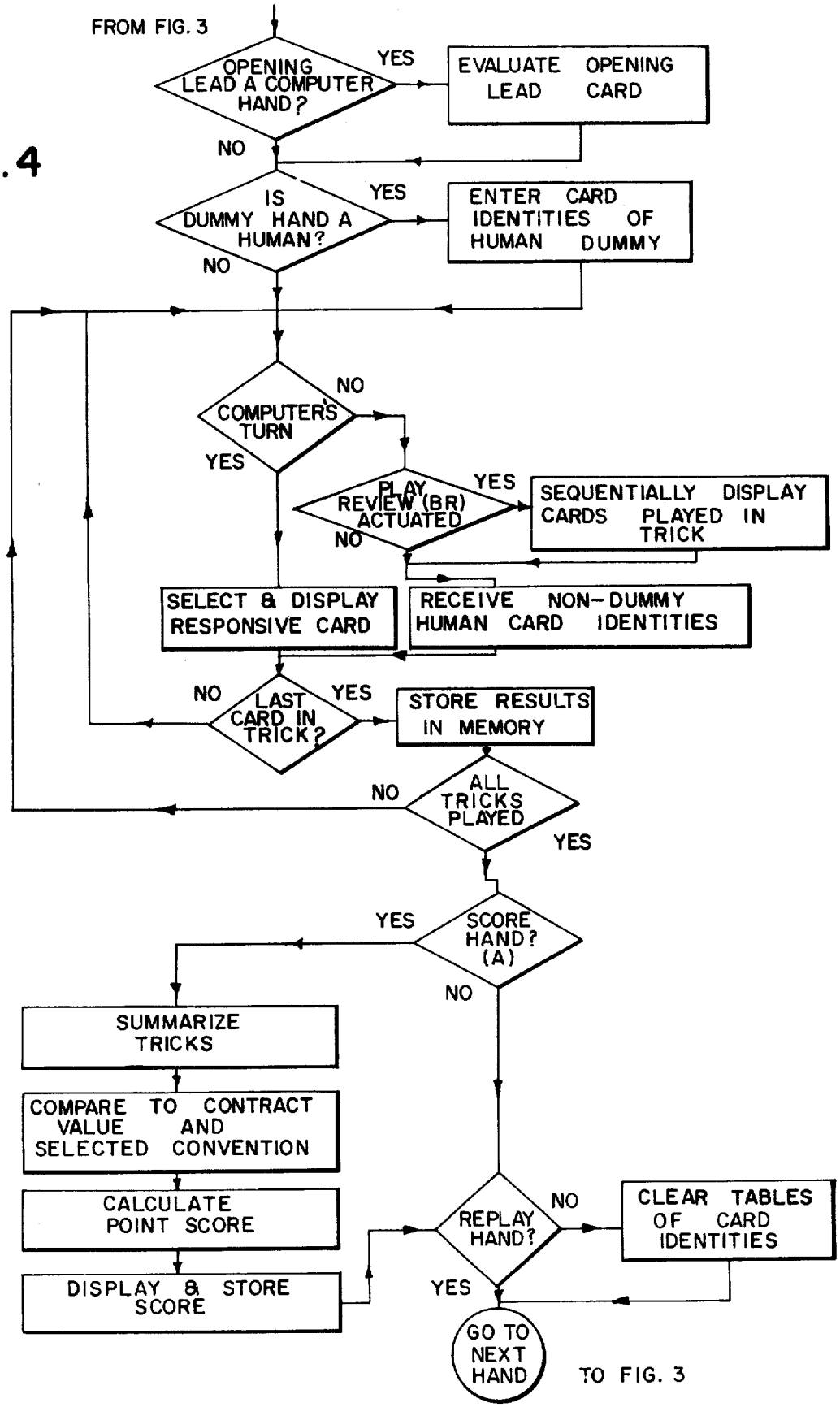

Referring to the operational flow diagram of FIGS. 3, 4 and 6, after the electronic game incorporating the electronic playing system of the present invention is assured of receiving AC power through its transformer 130, actuation of the reset key 22 assures that the computer is cleared of all previously entered data. At any time during a game, the computer may be cleared and play may be restarted by pressing the reset key 22.

Initial entries are made into the computer using the four keys 38, 40, 42 and 44. The Dealer position is set by key 38, which when pressed will cause the indicator lights of display means 14 to show the player position which is next to deal and the display window 60 will read "Dealer." Continual pressing of the key 38 will cause a different indicator light in position indicator 62 to illuminate. Once the desired geographical position for the Dealer is lit, the human player or operator should cease to depress key 38. This particular geographical position illuminated in indicator 62 will be assigned the dealer. If no particular dealer position is desired, the system will automatically assign north as the dealer.

The display window 60 will display the status of each player, human or computer, starting with the dealer, when the player key 44 is depressed. The indicator light 62 will show the player position and the player window 60 will show the status of that particular geographical positional player. To change status of the player, a human player or operator can press the clear key 26 which causes the status of the displayed geographical position to be reversed. Actuating the player key 44 again will cause the next player position to be similarly displayed.

Vulnerability status can be selected by pressing the vulnerability key 42 which functions to change the vulnerability status each time it is actuated. The indicator lights **64*a* and 64*b* will show the present state of vulnerability, north-south or east-west, respectively. If neither 64*a* or 64*b*** indicators are lit, no particular partnership is vulnerable.

A total of six conventions are available for selection to each partnership. Pressing the convention key 40 will rotate the display of the convention options for each partnership and show an option in display window 60. The player indicators 62 will show for which partnership the displayed convention refers to. To select a particular convention option, a human operator can press the clear key 26 when the desired option appears in the display window 60. The display window 60 will then place an asterisk next to the display information in a display window 60 to indicate that that convention is selected. The computer will then store the selected conventions into memory for later use. One must press the enter key 28 to exit this convention select routine.

After any desired convention, player status, dealer and vulnerability parameters are selected and inputted, the operator should then press the enter key 28. The computer system is then ready to receive identities of cards of hands which the computer will play on behalf of. The computer will signal which cards it will need by displaying the signal "Cards" in the display window 60 and will light up one of the geographical indicators 62. After manually dealing the cards out to the four players, each of the thirteen cards for each hand that the computer will play on behalf of will be fed into the computer by either one of two input means.

One input means, the scanner 16, can read specially coded data on each card which indicates the card's identity, i.e. value and suit. The coded data preferably comprises a bar code. The scanner 16 comprises a bar code reader and provides a means for directly interfacing a card with the input means so that the card's identity can be unexposed to the human players. Input of each card identity can also be accomplished by manually actuating one of the suit input keys 46 and one of the value input keys of 48, 50, 52 or key 54-2.

Upon inputting the identity of each card into the computer, the computer will assign a pad number from 1 to 13 for each of the cards for that hand and will display only this pad number if the card identities are entered via the scanner 16. Thus, if the identity of cards is inputted via the scanner 16, the card can remain face down, unexposed to human players, and a person can merely place each card on a different pad number on a playing pad having marked boxes numbered 1 through 13, respectively. When the card is later called for to be played by the computer, as will be explained below, the computer identifies the card by both its pad number and its identity. By also displaying the pad number, the operator can uncover the exact card the computer wishes to play without having to search all the cards in the hand. Thus, the unplayed card identities remain secret from the humans.

After all the necessary card identities are placed in memory, the computer then sets a pointer to the dealer. If the dealer is human, the word "bid" will appear in the display window 60 and one of the display indicators 62, will illuminate. A human will then place his bid via the input means 12 by selecting and actuating one of the suit input keys 46 and one of the numerical input keys of 52 or 54. The human player can also input a no trump bid by pressing input key 56.

After the bid is received, a computer provides a means for reviewing the bids made, in sequence up to the present bid. The bids can be reviewed by actuating input key 30. Continued actuation of input key 30 will display, in turn, each of the bids made up until the present.

If the computer was selected as the dealer, the computer will compute a responsive bid and display the bid in the display window 60. The human operator then has a choice; he can either accept the bid or make his own bid, thereby overriding the computer's choice. If the human desires to override, he inputs his own bid. If the human accepts the computer bid he must then press the acknowledge key 50 to acknowledge the responsive bid displayed in the display window 60. The bid is then inserted into the bid table and memory.

After the bid is inserted into memory, the computer determines whether the bid was a pass bid or a no pass or hand bid. If it was not a pass bid, a value assigned to a pass value is reset to zero. If the bid was a pass bid, a value assigned to a pass count value is incremented by one. The computer then checks to see whether the pass count has reached a value of three. If the value has not reached a value of three, the system then returns to receive bids from either the human or computer player after determining whether a human or computer player is to respond with a bid. If the pass count value has reached three, indicating that the last hand bid or non-pass bid is now the final contract, this contract value is stored in a contract value memory. In this way, the system adopts the last bid made prior to three consecutive pass bids being made as the contract value.

After the contract has been formed, it is displayed on the window display 60 and a human acknowledges by pressing the acknowledge key 50. The system then provides a means for changing the status of a hand from computer to human or vice versa after the bidding has been completed but before the cards are about to be played. If status change is desired, a human player or operator then actuates the problem key 32 which must be pressed before the acknowledge key 50 is pressed to acknowledge the final contract. The human operator will then press the player key 44 which will display the status of each player in succession. When the key 44 is continually pressed until the desired player whose status is to be changed is indicated on the display row 62. The player status is then changed by pressing the clear key 26. The display window 60 will then again display the final contract. At this point one must acknowledge by actuating the acknowledge key 50 and play will then commence. This will be indicated by the display window 60 displaying the word "play."

If the opening lead is a computer hand, the computer evaluates and responds with an opening lead card by choosing a card, from its hand being played, based upon preselected playing criteria stored in a program memory and other criteria. This responsive lead opening card is displayed in the display window 60.

The system then determines whether the dummy, the hand opposite the contract holder, is a human hand. If the dummy hand is a human hand, the values and identities of these cards held by the human-dummy hand must be inputted into the memory of the system so that it can play with full knowledge of these card identities. This request for cards is signalled to the human operators by the display window 60 displaying the words "cards." The cards of the dummy human are then inputted into the system using either one of the two input means, scanning or keyboard, described above. No particular pad number is assigned since the dummy human's cards are always arranged face up and are displayed in full open format, and thus their identities need not be kept secret.

The system keeps track of whose turn it is to play a card in a trick. If it is the computer's turn, it selects and displays a responsive card. The selection is based upon the identity of cards previously played by non-dummy humans which are stored in the memory means, the identity of system cards in the hand being presently played also stored in the memory means, the identity of cards played by the dummy hand, and the value of the contract stored in the contract value memory means. It also evaluates this responsive card in accordance with preselected playing criteria stored in the program memory.

If it is not the computer's turn to play a card in a trick, the system then offers an option to review the cards played in that trick in sequence. If a human player or operator actuates the bridge review key 30, the identity of the cards will be displayed in sequence in the display window 60 upon continued actuation of the bridge review key 30. The bridge review key 30 should be continually actuated until the display window 60 displays the words "play." The human player should then input the identity of the card from the non-dummy human, via the input means, into the memory of the computer system.

The computer system then determines whether the card just played is the last or fourth card in the trick being played. If this card is not the fourth card, the computer then returns and evaluates whether it is the computer's turn or the non-dummy human's turn to select and play a card. If the system has determined that the last card in the trick has in fact been played, the computer stores the results of the trick in memory for later evaluation.

The system then determines whether all thirteen tricks have been played. If all thirteen tricks have not been played, it then returns above to again determine whether it is a computer's turn (or a non-dummy human's turn) to play a card. However, if it has determined that all tricks have in fact been played, it then proceeds to score the hand if such scoring is desired.

After the final hand has been played, scoring is commenced by a human operator actuating the acknowledge key 50, thereby requesting that the hand be scored. If the acknowledge key 50 is actuated, the computer summarizes the tricks, compares the summary to the contract value and selected convention value, calculates a point score, and displays and stores the score into memory. Sequential display of summary, contract value, point score, and above and below the line score for each partnership is enabled by repeated actuation of the acknowledge key 50.

After the score is stored into memory, or if the scoring was not initially desired, the computer then determines whether the human operator desires to rebid and replay the deal of cards just played. Although this replay option may be exercised at any time during play of the hands up to and including after the final trick, the flow chart of FIG. 3 illustrates this option only at the end, after all the tricks have been played.

If a human operator decides that a replay of hands is desired, the pass key 58 should be manually actuated.

The word "quit" will be displayed and acknowledgement by actuating acknowledge key 50 is necessary. The word "replay" will be displayed in the display window 60. The acknowledge key 50 should again be actuated and the display will then show the word "dealer" in the display window 60. Manual actuation of the enter key 28 will initiate the bidding sequence. At this point, the system will allow a change of positions or status of the hands but will keep the identity of each card in the hand in its memory.

If a replay of the hand is not desired, the tables in memory are cleared of card identities being stored in them. The system then returns to the beginning of the play sequence and is ready to receive choices of dealer, player, vulnerability and the convention inputs.

It should be noted that the bridge game system can be used even if all four players are human. It will then receive bids, have the review functions available and score the hands.

Figure 5:
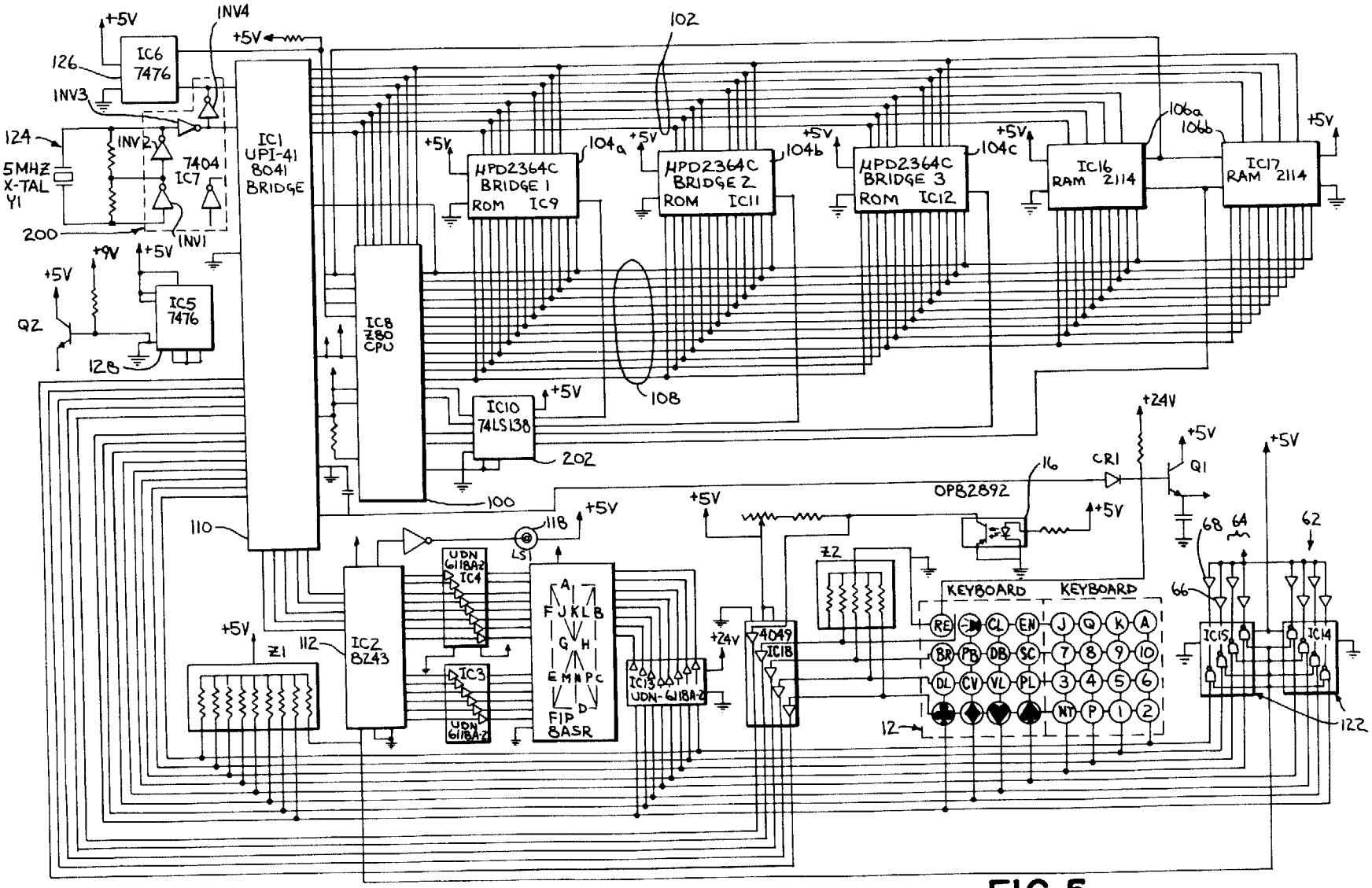
FIG. 5 is in electrical schematic of the electronic components utilized in the game of the present invention.

A more detailed description of the circuit components will now proceed. Referring now to FIG. 5, the Reset function is activated when the game is plugged in or when the Reset (RE) key 22 is pressed. In either case, the function is identical. Capacitor C1, connected between ground and pin 4 of IC 1, 110, and pin 26 of IC 8, 100, charges from 0 volts (during Reset) to +5 volts when the game is running. The reset charging voltage is an internal function of IC 1, 110, and is not provided through diode CR1. CR1 provides isolation between the reset circuit associated with IC 1, 110, and IC 8, 100, and the reset circuit for the 8243 expander chip (IC 2), reference numeral 11. The reason for this isolation is because IC 2, 112, does not have a reset input, but its reset is accomplished by turning IC 2, 112, off and then turning it on again.

The reset circuit consists of transistor Q1, which acts as a switch to provide power to IC 2, 112, via the +5-volt output, and resistor R3. R3, which is connected to the +24-volt supply, provides the necessary bias on Q1 to ensure that the output of Q1 is at a uniform +5 volts DC. Capacitor C10 provides ripple suppression for the +5-volt output. When Reset key 22 is pressed, the base Q1 goes to 0 and pin 4 of IC 1, 110, and pin 26 of IC 8, 100, go to approximately 0.7 volts. Thus, Q1 is turned off, which removes power from IC 2 and starts the negative going side of the reset pulse to IC 1, 110, and IC 8, 100. When Q1 is turned on again, IC 2, 112, is reset and IC 1, 110, provides the positive side of the reset pulse to itself and IC 8, 100.

The Clock Generator consists of a crystal-controlled oscillator using a 5 MHz crystal (Y1) in conjunction with two inverters INV1 and INV2 and two 1K resistors R7 and R8. The inverters INV1, INV2 are part of IC 7, 200, with common input at pin 1 and final clock output at pin 4 of IC 7, 200. The inverter output at pin 6 provides phase inversion and is used to drive IC 1, 110, via pin 3. The output at pin 8 of IC 7, 200, provides a second phase inversion for input at pin 2 of IC 1, 110, and also drives the divide-by-two frequency divider (IC 6), 126, to generate one-half the original clock frequency which is needed to operate the Z80 (IC 8) CPU, designated by reference numeral 100. IC 6, 126 is a JK flip-flop and is wired to perform the function of a toggle flip-flop. The input (at pin 1) is set to a value of one, and the clock input causes the output at pin 15 to toggle at one-half the clock frequency. Resistor R4 provides the drive for the clock input to IC 8, the CPU, 100.

The Z80 Central Processing Unit (IC 8), designated by reference numeral 100, controls all memory addressing and memory read/write operations. A memory address function is accomplished using the IC 10 logic chip, 202, to provide a memory select signal. When the Central Processing Unit (CPU), 100, generates a memory address (A0 through A14), bits A13 and A14 are used by IC 10, 202, to create a memory select code (A15 is not used). The memory request (MREQ) and memory refresh (RFSH) signals from the CPU, 100, to input pins 4 and 6 of IC 10, 202, are used to trigger a select signal for the appropriate RAM or ROM, based on the memory select code. IC 10, 202, generates one of four separate memory select signals. The three ROM's (IC 9, 11, and 12) are individually selected, via a select input at pin 20. The ROM's are in parallel connection with the Data Bus 102. The two RAM chips (IC 16, IC 17), **106*a* and 106*b* are selected in parallel, via pin 8. Each RAM contains ½-byte of information and is connected to four lines of the 8-bit Data Bus. A read or write function for the RAM's is determined by the write enable line (pin 10) of IC 1**.

Contact with the human player is controlled by the Input/Output Controller (IC 1), 110. The I/O Controller 110 consists of an 8041 IC chip and effects all communication between the player and the Z80 CPU 100 with the bridge program. Data is transmitted via bus lines D0 through D7, 102. Control signals are maintained through the A0 input at pin 9 which informs the I/O Controller 110 of the transfer mode, the Read (RD) input at pin 10, the Write (WR) input at pin 8, and the Chip Select (CS) input at pin 6.

The basic system clock signals are applied at pins 2 and 3. For internal timing, a pulse is supplied at pin 39 (T1) from IC 5 pin 11. The JK flip-flop (IC 5) provides one pulse out for every four pulses in at pins 1 and 6. The input pulses come from the synch output (pin 11) of IC 1. The output at pin 10 of IC 5 provides the trigger for the pulsed DC filament voltage which is generated through transistor Q2.

Input and output information for the I/O Controller is multiplexed via P10 through P17 (pins 27–34) on a one-out-of-eight basis; only one of these eight lines will be high at any given time. The other seven lines will be at a logic low. The eight lines service the display digits, the keyboard columns, and the individual LED's.

The display digits are driven through IC 13 from the multiplexed lines. Pullup resistor network Z1 provides the drive capability for the multiplexed lines. IC 13 provides the drive capability for the multiplexed lines. IC 13 provides +24 volts required to activate the digits in the alpha-numeric display (DS9), 116. The most left-hand digit (MSD) is controlled via input pin 19 of DS9; the most right-hand digit (LSD) is controlled via input pin 26 of DS9. DS9, 116, is a 14-segment, 8-digit vacuum fluorescent display device using a pulsating DC filament voltage with an RMS value of 2.5 volts. The filament circuit is between pins 18 and 1 of DS9; pin 18 receives filament AC (pulsed DC) from transistor Q2 and pin 1 is the common connection.

Segment information enters DS9 via pins 2 through 16 (pin 10 is not used). IC 3 and IC 4 drive the segment lines under control of IC 2. IC 2 serves as an Expander, providing 16 additional output lines from the I/O Controller. IC 2 is multiplexed to IC 1 via five data lines (PROG, P20 through P23) between pins 21–25 on IC 1 and 7–11 on IC 2. IC 2 also provides the output for the Tone Transducer (LS1), 118, at pin 14 through driver IC 7. IC 2 also controls the individual LED's, DS1 through DS8, via output pin 13 (P70), by providing an enabling signal when the appropriate multiplexed information is input to IC 14 and IC 15. IC 14 and IC 15 drive the LED's DS1 through DS8.

The multiplex information lines enter each Keyboard at pins 2, 5, 8 and 10 to provide the enabling pulse for sequencing key inputs to the I/O Controller. Key output information is transmitted via output pins 3, 4, 7, 9 1 or 6 on the Keyboards through inverter network IC 18 directly to the I/O Controller. Key data enters IC 18 at pins 3, 5, 7 and 9 and is input at pins 2, 4, 6 and 10 on direct lines to IC 1 (P24–P27). Resistor network Z2 is used on the inputs of IC 18 to ensure a low input signal when no key has been pressed.

IC 18 also provides the drive for the Scanner output 16. The Scanner signal enters IC 18 at pin 11, is inverted, and exits at pin 12 on a direct line to pin 1 (T0) of IC 1. The Scanner (V1) consists of a light emitting diode, a phototransistor, a transparent lens and a current limiting resistor (R1). The diode emits infrared light through the transparent lens to be reflected or absorbed by the special coded image on the face of the card being scanned. The reflected light returns through the lens to the phototransistor, causing the transistor to saturate driving the output at pin 1 low (1 volts). The amplitude of the signal required for saturation is adjustable via potentiometer R6. Resistor R2 is used for current limiting in this circuit.

The evaluation criteria used in the bidding sequence is more fully described in a pamphlet supplied with the game, entitled, "The Bridge Challenger Bidding System," written by Timothy R. Scanlan and distributed by Fidelity Electronics, Ltd.

The instruction manual supplied with the game contains instruction material to instruct players in the game operation. A service manual published by Fidelity Electronics, Ltd. also contains material on game operation. The material contained in the pamphlet, instruction manual and service manual is herein incorporated by reference.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. An electronic game playing system for performing in the place of at least one of the plurality of human players which normally play bridge card games selected functions normally performed by one or more of the players comprising:

memory means for storing data required for the play of the game including data representative of the identity of cards to be played by the system, data representative of cards played by the players and the system, data representative of each bid in a sequence of a plurality of bids made by the player and the system, and including data received by system data input means;

system data input means including card input means for receiving selected card identity data and bid input means for receiving bid data representative of each of a sequence of bids by the players;

means for producing positional identity data representative of the relative position of each of the card hands;

bid response means for selecting a sequence of one or more bid values for each of the card hands being played by the system in response to the card identity data for each such hand and in response to each prior bid in the sequence of said bid data stored in said memory means in accordance with preselected criteria stored in memory;

contract value memory means responsive to a selected sequence of bids for storing data representative of the last bid prior to said selected sequence and for storing the positional identity data representative of the card hand making said last bid;

card playing means for selecting data representative of a card from the cards in each of the card hand being played by the system in response to the identity of cards played by the human players, the identity of cards in the hand being played by the system and the value stored in said contract value memory means in accordance with preselected playing criteria; and display means for displaying the bid values selected by the system and the identity of the each card selected by the system.

2. The electronic game system of claim 1 wherein:

said card input means includes a scanning means for sensing coded data on each card indicative of its identity.

3. The electronic game system of claim 2 wherein:

said scanning means comprises a bar code reader and said coded data on each card is a bar code.

4. The electronic game system of claims 1 or 2 wherein:

said display means selectively displays additional information including the identity of each of the cards played by each player and the positional identity of the hand from which the card identity is being displayed.

5. The electronic game system of claims 1 or 2 wherein:

said display means selectively displays additional information including the data received by said bid input means and the positional identity of the hand whose bid data is being displayed.

6. The electronic game system of claim 4 wherein:

said display means selectively displays additional information including the data received by said bid input means and the positional identity of the hand whose bid data is being displayed.

7. The electronic game device of claim 1 wherein said system data input means includes:

convention input means for receiving bid convention option data chosen by the players.

8. The electronic game system of claim 7 including:

play review means selectively operable for sequentially effecting a display by said display means of the identity of each card played by a player and by said system during a current sequence of cards played at any time during play of that sequence.

9. The electronic game device of claim 1 including:

scoring means responsive to the results of cards played and the bid data value stored in said contract value memory means for calculating a point score, for comparing the results of the cards played with the bid data value, and for storing said point score in said memory means after all the cards have been played.

10. The electronic game system of claim 1 including: bid review means selectively operable for sequentially effecting a display by said display means of each bid of said sequence of bids made by the players and the system at any time during the bidding sequence.

11. The electronic game system of claim 1 including means responsive to the input of card identity data for each card in a hand being played by the system for assigning a distinct placement value to each card in each said hand played by the system to facilitate identification of each such card by said placement value without revealing its identity to the players.

12. The electronic game system of claim 1 including: replay means selectively operable for allowing input of new bid data and card data for the same card hands previously played.

13. The electronic game device of claim 1 including status switch means for changing status of a hand after the bidding is complete but before the hands are to be played, in response to actuation of a switch input key.

* * * * *